United States Patent [19]

Gestaut

[11] 4,450,187

[45] May 22, 1984

[54] IMMERSION DEPOSITED CATHODES

[75] Inventor: Lawrence J. Gestaut, Painesville, Ohio

[73] Assignee: Diamond Shamrock Corporation, Dallas, Tex.

[21] Appl. No.: 366,880

[22] Filed: Apr. 9, 1982

[51] Int. Cl.[3] ..... B05D 5/12; C23C 3/02

[52] U.S. Cl. ..... 427/125; 148/6; 427/123; 427/224; 427/304; 427/307; 427/405; 427/437

[58] Field of Search ..... 148/6 R; 427/307, 437, 427/405, 224, 304, 115, 123, 125

[56] References Cited

U.S. PATENT DOCUMENTS 1,915,473 6/1933 Raney .

3,935,345 1/1976 Lema ..... 427/307

4,328,080 5/1982 Harris ..... 427/307

*Primary Examiner*—John D. Smith

*Assistant Examiner*—Janyce A. Bell

*Attorney, Agent, or Firm*—Woodrow W. Ban; Arthur S. Collins

[57] ABSTRACT

A method for providing an electroless plate, particularly a discontinuous plate for uses such as for electrolytic cell cathodes. A nickel substrate is interdiffused with a second metal which, when leached out leaves a hydrogen adsorbing surface upon the substrate. The substrate is then contacted with a dilute, at least 20 ppm, solution of the plating metal, preferably with the plating metal in anionic complex in the solution. Following immersion, the resulting plated substrate is passed through a reducing flame.

16 Claims, No Drawings

IMMERSION DEPOSITED CATHODES

FIELD OF THE INVENTION

This invention relates to electroless metal deposition or plating particularly of electrode structures. More specifically this invention relates to a cathode for use in an electrochemical cell such as a chloralkali cell, and to methods for electroless deposition of a conductive, catalytic surface to such a cathode.

BACKGROUND OF THE INVENTION

Electroless plating of metals onto other metals is relatively well known. A variety of metals have been successfully plated using these conventional techniques for electroless plating.

In conventional electroless plating an object to be plated is immersed into a bath, plating being conducted from the bath. Such a bath generally includes ions of the metal to be plated upon the object and a reducing agent. One drawback to such electroless plating systems is an occasional sudden precipitation of the metal ion values from the bath. Termed a bath crash, this precipitation is generally triggered by a chemical imbalance in the bath, but nonetheless can cause severe upsets in processes utilizing electroless plating.

Conventional electroless plating baths generally utilize relatively elevated concentrations of metal ions to effect a speedy and effective electroless plate. These elevated concentrations can result in significant losses of metal ions from the bath through drag out, bath carried from the plating process upon finished pieces, and the like.

Maintenance of the level of reducing chemicals or agents in these baths requires careful attention if crashes are to be forestalled. Many typical reducing chemicals utilized in electroless plating baths such as formaldehyde, can pose hazards in the workplace. Processes eliminating reducing agents from the electroless plating baths therefore offer substantial utility.

DESCRIPTION OF THE INVENTION

The present invention provides a method for electroless plating wherein the plating bath need not include a reducing agent. The method finds utility in the preparation of cathodic electrodes for use in electrochemical cells such as chloralkali generation cells.

The process of the instant invention commences with the selection of a substrate metal to be electroless plated. Surfaces of the substrate to be plated are interdiffused with a second metal. The second metal is then preponderately leached from the interdiffused surface leaving a surface generally including adsorbed hydrogen. The substrate is then immersed into a plating bath containing ions of the metal it is desired be plated upon the substrate surfaces.

The metal ions are deposited onto the substrate surface from plating baths having at least 20 parts per million plating metal on a metal weight basis, and preferably at least about 50 parts per million. It is much preferred that the metal ion be in the form of an anionic metal complex.

It is necessary to the practice of the invention that the substrate, following interdiffusion and subsequent leaching of the second metal, have a substrate metal surface readily adsorbing hydrogen and preferably including hydrogen. Nickel substrates and zinc or aluminum metals for interdiffusion are much preferred.

It is desirable that, following immersion in the plating bath, the now plated substrate be contacted with a reducing flame momentarily.

The above and other features and advantages of the invention will become apparent when considered with a description of a preferred embodiment of the invention forming a part of the specification.

BEST EMBODIMENT OF THE INVENTION

The process of the present invention provides an electroless plate upon a substrate. The method finds particular utility in the fabrication of cathodic electrodes for use in electrochemical cells.

Under the method, surfaces of the substrate are interdiffused with a second metal, and a preponderance of the second metal is then leached from the interdiffused surface to leave a surface readily adsorbing, and generally including adsorbed hydrogen. Suitable substrate metals include nickel and cobalt. It is believed essential that the suitable substrates be possessed of the capability for adsorbing hydrogen after interdiffusion with a second metal and subsequent leaching out of a second metal.

The second metal should be capable of imparting to the substrate metal after interdiffusion and leaching, a substrate surface having hydrogen adsorbing tendencies. For nickel and cobalt, zinc and aluminum are satisfactory second metals, other suitable or conventional second metals contemplated as being within the purview of the invention.

By interdiffused what is meant are suitable or conventional techniques for forming an intermetallic or solid solution between the substrate metal and the second metal at surfaces of the substrate metal. By solid solution what is meant is a homogeneous crystallization phase composed of at least two distinct chemical species occupying crystal lattice points generally at random over a range of concentrations between the species. By intermetallic compound what is meant is an alloy of two metals in which a progressive change in composition between the metals is accompanied by a progression of phases of differing crystal structures and sometimes termed electron or Hune Rothery compounds.

Among the suitable or conventional techniques for forming the intermetallic or solid solution of the second metal and the substrate surface are: electrodeposition of the second metal upon the substrate followed by heating to interdiffuse; fused salt electrodeposition at a temperature sufficiently elevated to promote interdiffusion; immersion of the substrate into a molten bath of the second metal; and plasma spraying of the second metal upon the substrate.

Leaching can be conveniently accomplished by contact with an aggressive metal hydroxide such as NaOH or KOH. Other suitable or conventional leaching techniques are contemplated. At least a preponderance, but not necessarily all the second metal should thereby be removed from the interdiffused surface.

The substrate, following interdiffusion and leaching, is immersed in a bath or solution of ions of a metal to be electroless plated upon the metal substrate. It is much preferred that this metal ion actually be in the form of an anionic complex of the metal to be plated. What is meant by anionic complex is an anion of the form $M_xA_y^{-z}$ where M is the metal to be plated, A is a negatively charged species, z is a number generally not less than 1, and x and y represent the stoichiometry necessary to provide the complex valence of $-z$. Typically A is an $NO_3^-$ or halogen species, while M is generally a conductive metal. Suitable metals include Ag, Cu, Ru, Rh, Pd, Pt, Au, and Ir. Typical anionic complexes include $AuCl_4^-$, $PtCl_6^{--}$, $RuCl_4^-$, $RhCl_4^-$, $CuCl_3^-$, $AgCl_2^-$ and the like. $AgNO_3$ is also effective and is included under the term anionic complex.

Concentration of the metal ion species in the bath or solution can be as dilute as about 20 parts per million on metal weight basis. A concentration of 50 parts per million or more is preferred. The optimal concentration for any particular application will be one that provides a relatively rapid coating upon the substrate, and yet provides a desirably low drag out of metal ion species from the bath as substrates are removed following electroless plating.

The coating or plating provided upon the substrate need not be continuous. For example, a nickel substrate having a platinum plating or coating for use as a cathode within a diaphragm type chloralkali cell is prepared by immersion of the substrate for about 20 seconds in a bath containing $PtCl_6^{--}$ in a concentration of 50 parts per million platinum. A non continuous coating results upon the cathode providing electrolytic cell performance approximately equal to that of cathodes having a fully continuous electrodeposited platinum coating.

The bath containing the metal anionic species generally contains an acid of the anionic material. For $PtCl_6^{--}$, $RhCl_4^-$ and the like, the bath is generally at least mildly acidic, generally achieved by introduction of muriatic acid into the bath.

Following immersion in the plating bath or solution, it is generally desirable that surfaces coated or plated according to the instant invention be contacted briefly with a reducing flame. Typically an hydrogen flame is utilized, but any suitable or conventional reducing environment serving to stabilize the plated substrate surfaces will suffice.

It is believed that the hydrogen adsorbing surface that results upon the substrate metal following leaching out of the interdiffused second metal functions as a reducing agent during electroless deposition of the metal anionic complex. One postulated exemplary process can be written:

| | |
|---|---|
| Ni + Zn | Ni/Zn |
| Ni/Zn + NaOH | Ni(H) + by products |
| Ni(H) + $AgNO_3$ | Ni/Ag |

It appears particularly desirable that the metal anionic $H_tM_xA_y^{-z}$ complex be of the form $H_tMZn$ where y, t, x and z are integers, M is the metal and A is a halide or pseudohalide, soluble in aqueous environment to yield $H_sM_xA_y^{z-1}$ where $s=t-1$ but not less than zero.

The following examples are offered to further illustrate the invention.

EXAMPLE I

Four 3.8×3.8 centimeter squares of wire mesh were fabricated from commercially pure nickel wire. Elemental zinc was electrodeposited onto these metal meshes to produce a weight gain in the metal mesh as shown in Table I. These metal meshes were then leached in caustic until gas evolution ceased.

TABLE I

| Sample | Zn Wt gain (gr) | $AgNO_3$ Conc. (molar) | Contact time (Sec.) |
|---|---|---|---|
| 1 | 0.1196 | 0.1 | 5 |
| 2 | 0.1573 | 0.1 | 1 |
| 3 | 0.2323 | 0.01 | 1 |
| 4 | 0.0513 | $1.0 \times 10^{-4}$ | 10 |

The metal meshes were then contacted with silver nitrate solutions of varying concentrations as displayed in Table I for contacting times as shown in Table I. Samples 1 through 3 were found to have a non-continuous silver coating following immersion for the specified contact time. Sample 4 was found to be not significantly coated. Of the three samples displaying silver coatings, the silver coating sluffed off relatively easily with abrasion. However passage of the silver coated mesh through a hydrogen flame for a contact time of only a few seconds sufficed to harden the coating making the coating abrasion resistant.

The silver plating, under microscopic analysis, was observed not to be uniform. The silver plate had a bumpy appearance and an x-ray map of silver plated mesh indicated that the silver was not evenly distributed over the surface of the nickel. A cross section of the silver plated nickel mesh sample had a porous appearance in its outer layer apparently where zinc had been leached out of the nickel-zinc interdiffused layer.

EXAMPLE II

A nickel mesh similar to those in Example I, was cleaned with dilute nitric acid for one minute, washed with deionized water, and then blotted to dry. The mesh was then immersed in a 0.1 molar silver nitrate solution for 60 seconds. No plating action was observed on the nickel mesh. This would appear to preclude the reaction sequence:

| | |
|---|---|
| Ni | $Ni^{++} + 2e^-$ |
| $2Ag^+ + 2e^-$ | 2Ag |

to yield a net reaction of:

$$Ni+2Ag^+Ni^{++}+2Ag$$

as the reaction controlling plating in nickel substrates.

EXAMPLE III

Approximately 10 centimeter by 10 centimeter nickel mesh samples were interdiffused with zinc in accordance with Example I by electrodepositing approximately 0.2 of a gram of zinc on each sample and by subsequent heating in an argon atmosphere at 300° C. for 2 hours. These mesh samples were then cut into strips and contacted with caustic until gas evolution ceased. Strips were contacted separately with $3.0\times10^{-3}$ molar solutions of:

(1) $H_2PtCl_6$ in $H_2O$
(2) $HAuCl_4$ in $H_2O$
(3) Trans-$Pt(NH_3)_2Cl_2$ (as a suspension) in $H_2O$
(4) $CuSO_4$ in $H_2O$
(5) $H_2Pt(SO_3)_2$ OH in $H_2O$
(6) $H_2PtCl_6$ in $CH_3CH(OH)CH_3$
(7) $RuCl_3$ in $C_2H_5OH/H_2O/CH_3CH(OH)CH_3$ Solution numbers 1, 2 and 4 were observed to have established a definite plate, and numbers 6 and 7, repeated in weak muriatic acid in lieu of the originally tested solvents, also established a plate.

While a preferred embodiment of the invention has been shown and described in detail, it should be apparent that various modifications and alterations may be made without departing from the scope of the claims appended.

What is claimed is:

1. A process for the electroless plating of a metal upon a substrate metal comprising the steps of:

selecting a substrate metal capable of adsorbing hydrogen;

interdiffusing surfaces of the substrate metal with a second metal;

leaching a preponderance of the second metal from the interdiffused surface to leave a surface tending to include adsorbed hydrogen; and immersing the substrate metal into a plating bath containing ions of the metal to be plated upon the substrate.

2. The process of claim 1, the ions being anionic complex ions of the metal to be plated.

3. The process of claim 2, the ions being present in a concentration of at least 20 parts per million on a metal weight basis in the plating bath.

4. The method of any of claims 1–3, plated surfaces of the substrate being contacted with a reducing flame subsequent to immersion in the plating bath.

5. A process of electroless metal plating onto a nickel substrate comprising the steps of:

applying a coating of one of elemental zinc and elemental aluminum to the substrate to form a substrate surface of interdiffused zinc or aluminum and nickel;

leaching a preponderance of applied coating metal from the substrate; and immersing the leached substrate into a bath containing ions of a metal to be plated upon the substrate.

6. The process of claim 5 including the additional step of passing the plated substrate surfaces after immersion through a reducing flame.

7. The process of either of claims 5 and 6, the bath containing at least 20 parts per million of the metal ion.

8. The process of claim 7, the metal ion being in the form of an anionic complex.

9. The process of claim 8, the anionic complex being selected from a group consisting of $AuCl_4^-$, $PtCl_6^{--}$, $RuCl_4^-$, $RhCl_4^-$, $CuCl_3^-$, $AgCl_2^-$, and $AgNO_3$.

10. A process for electroless metal plating of a nickel substrate comprising the steps of:

forming upon the substrate a surface of one of interdiffused zinc and nickel and interdiffused aluminum and nickel;

leaching a preponderance of the zinc or aluminum from the interdiffused surface; and immersing the substrate in a bath containing a metal to be plated onto the substrate, the metal being in the form of an anionic complex of the metal, the metal comprising at least 20 parts per million of the bath and the anionic complex being selected from a group consisting of $AuCl_4^-$, $PtCl_6^{--}$, $RuCl_4^-$, $RhCl_4^-$, $CuCl_2^-$, $AgCl_2^-$, and $AgNO_3$.

11. The process of claim 10, the substrate, following immersion for plating of substrate surfaces, being contacted with a reducing flame.

12. The process of either of claims 10 and 11, the anionic metal complex being present in a concentration of at least 100 parts per million on a metal weight basis in the bath.

13. A method for making a cathode for use in an electrolytic chloralkali cell comprising the steps of:

selecting a nickel cathode substrate;

interdiffusing surfaces of the nickel cathode substrate with one of zinc and aluminum;

leaching out a preponderant portion of the interdiffused zinc or aluminum from the cathode surfaces;

immersing the cathode in a solution containing an anionic metal complex of desired conductive cathode surface metal; and passing the electrode surfaces through a reducing flame.

14. The method of claim 13, the anionic complex being present in a quantity at least greater than about 50 parts per million on a metal weight basis in the solution.

15. The process of one of claims 13 and 14, the anionic complex being selected from a group consisting of: $AuCl_4^-$, $PtCl_6^{--}$, $RuCl_4^-$, $RhCl_4^-$, $CuCl_3^-$, $AgCl_2^-$, and $AgNO_3$.

16. The process of claim 1 wherein the substrate metal is nickel or cobalt and the plated surfaces of the substrate are contacted with a reducing flame subsequent to immersion in said plating bath.

* * * * *

UNITED STATES PATENT AND TRADEMARK OFFICE

CERTIFICATE OF CORRECTION

PATENT NO. : 4,450,187

DATED : May 22, 1984

INVENTOR(S) : Lawrence J. Gestaut

It is certified that error appears in the above-identified patent and that said Letters Patent are hereby corrected as shown below:

In Claim 5, column 5, line 31, delete "of" and insert --for--.

Signed and Sealed this

*Twenty-third* Day of *October 1984*

[SEAL]

*Attest:*

GERALD J. MOSSINGHOFF

*Attesting Officer*

*Commissioner of Patents and Trademarks*